US005764595A

United States Patent [19]

Power

[11] Patent Number: 5,764,595

[45] Date of Patent: Jun. 9, 1998

[54] DIRECTIONAL ACOUSTIC TRANSDUCER

[76] Inventor: Jeffrey Power, 22 Cambridge Rd., Oakington, Cambridge CB4 5BG, England

[21] Appl. No.: 849,912

[22] PCT Filed: Dec. 12, 1995

[86] PCT No.: PCT/GB95/02894

§ 371 Date: Jun. 18, 1997

§ 102(e) Date: Jun. 18, 1997

[87] PCT Pub. No.: WO96/19796

PCT Pub. Date: Jun. 27, 1996

[30] Foreign Application Priority Data

Dec. 19, 1994 [GB] United Kingdom ..... 9425577

[51] Int. Cl.[6] ..... H04R 17/00

[52] U.S. Cl. ..... 367/103; 367/138; 367/157

[58] Field of Search ..... 367/103, 138, 367/157; 310/320

[56] References Cited

U.S. PATENT DOCUMENTS 4,445,207 4/1984 Sternberg ..... 367/150

4,780,860 10/1988 Sasakura et al. ..... 367/138

5,327,397 7/1994 Burke et al. ..... 367/103

5,596,550 1/1997 Rowe, Jr. et al. ..... 367/103

5,608,690 3/1997 Hossack et al. ..... 367/138

*Primary Examiner*—J. Woodrow Eldred

*Attorney, Agent, or Firm*—Elman & Associates

[57] ABSTRACT

Many transducers suffer from the problem that the way they behave in response to actuating signals of different frequencies, and particularly their directional properties, or beamwidth, depends on their physical size and shape. What is required is a transducer which changes its effective size as a function of frequency, and the present invention proposes such a transducer in which the transducer element (11, 12, 13)—the active part of the transducer, such as the diaphragm in a loudspeaker—permits automatic frequency-sensitive control of the beamwidth by providing frequency-dependent "shading" of the local response to the signal across the face of the element, using a resistive coating (11) in association with a capacitive layer (12, through which the currents representing that signal travel) such that the CR value of the combination varies over the surface of the element.

21 Claims, 5 Drawing Sheets

DIRECTIONAL ACOUSTIC TRANSDUCER

FIELD OF INVENTION

This invention relates to transducers, and concerns in particular acoustic transducers with controlled directivity.

BACKGROUND TO THE INVENTION

A transducer is a device that converts energy in one form into energy in another form. Sound is a longitudinal waveform comprising pressure waves travelling through a compressible medium. The waves may be at a frequency which matches that of the human hearing capabilities—roughly from about 30 Hz up to about 20 kHz—or they may be above or below this range (respectively ultrasonic and subsonic; dogs and bats can hear ultrasonics up to about 40 kHz, whilst whales appear responsive to subsonics at around 10 to 15 Hz). The medium through which the sound waves travel may be a gas such as air, a liquid such as water, or a solid such as the earth or a metal rod. An acoustic transducer is a device that can be used to convert energy between a sound form (for radiation through such a medium) and another form, usually that of electrical energy.

Most acoustic transducers exhibit the property of reciprocity—that is, they can effect conversion between sound and electricity in both directions. Thus, such an acoustic transducer may convert electrical energy into sound or it may convert sound energy into electricity. A typical example of such a transducer that converts electrical energy into sound energy is a conventional domestic loudspeaker, as in a Hi-Fi system, which is fed with energy in the form of an electrical signal defining some sort of sound—music, perhaps, or speech—and then changes that electrical energy into sound energy by using the former to move some kind of air-encompassed active element such as a diaphragm back and forth in an appropriately-corresponding manner so as to produce matching pressure waves in the air itself, these waves constituting the required sound. Another example of an acoustic transducer is the loudspeaker-like device, known as a projector, employed in a SONAR system to convert an electrical signal into a sound signal travelling through water. A third example is that of those transducers that generate sound to be radiated into the earth; these are employed in the oil industry to send sound into the ground to determine from the received echoes whether the underlying strata are of the type that might be oil-bearing.

A typical example of an acoustic transducer that effects the opposite conversion—sound energy into electrical energy—is a microphone, as used conventionally to receive speech or music. A microphone that receives sound travelling underwater is a hydrophone, while one that receives sound travelling through the earth is a geophone.

All transducers suffer from imperfections in the accuracy with which they convert waveforms in one energy form into waveforms in another, but they can suffer from what at first sight seems to be a rather strange problem; the way they behave, and particularly their directional properties, depends on their physical size and shape. With reference to a conventional loudspeaker, this can be illustrated and explained as follows.

A typical domestic loudspeaker has within its box two, or even three, actual transducer diaphragms involved in the conversion process. One, the "woofer", deals with low frequencies (long wavelengths), and is large; a second, the "tweeter", deals with high frequencies (short wavelengths), and is small; and if there is a third, a "mid-range" unit, then it deals with the intermediate frequencies (and wavelengths), and is of a correspondingly intermediate size. One major reason—there are others—for this use of diaphragms of different sizes being provided to deal with sound of different frequencies (and, of course, different wavelengths) is because as the frequency increases, and the wavelength of the sound decreases to become comparable with the physical size of the transducer's diaphragm, so the way the transducer behaves, particularly in respect of its directionality, changes, not always beneficially. For example, a conventional domestic loudspeaker is generally required to be omnidirectional—radiating sound evenly all around it—but as the frequencies it handles increase such that the sound wavelengths become similar to or smaller than the size of its moving parts (the diaphragm) so it becomes more and more directional, which is not favourable. However, this can be counteracted by separating the sound-defining electrical signal into channels of different frequency ranges, and feeding each range to the appropriately-sized diaphragm.

Conversely, in other applications, such as SONAR systems, it may be desirable for the output sound signal to be very directional, and yet for the system to be able to use different sound frequencies (and thus wavelengths) for different purposes or conditions, and if at some of these the system changes its directional characteristics then this may be a serious disadvantage.

The well-known dimensional problems of transducers may be further discussed as follows.

When a (linear) transducer is small compared to the wavelength of the sound involved the response will always be omnidirectional. However, when the dimensions of the transducer are comparable to or larger than the wavelength there are two quite separate features of the directional properties which become apparent. Firstly, the directivity pattern of the response may not simply be a single "beam", but it may have many "sidelobe" responses pointing in directions which might not be desired. Secondly, the range of angles covered by the main "beam" of the response will change as frequency is changed (the width of the main beam will usually be inversely proportional to the ratio of size to wavelength).

The first feature, that of sidelobes, is due to diffraction effects associated with the finite size of the transducer, and can best be described as an "edge effect", since it is due to the sudden changes in motion at the edge of the transducer. These sidelobes may be reduced by a constant "shading" or "apodising" of the transducer in various ways, these usually involving a gradual tapering of the motion of the transducer towards its edges. There is a wealth of Art devoted to this effect, as discussed further hereinafter, and many transducers are available which have greatly reduced sidelobe levels.

None of these help with the second feature, however, namely that of the main beam changing its width with changing frequency; this requires more than just a simple shading function or apodisation which is constant (i.e. frequency independent) to affect it. Thus, it requires the provision of a shading function which actually changes in a suitable way as frequency changes. In other words, what is required is a transducer which changes its effective size as a function of frequency . . . and it is in this way that the present invention seeks to find a solution to the problem, by suggesting the use of a transducer element—the active part of the transducer, such as the diaphragm in a loudspeaker—that quite automatically changes its effective size in a way that matches the changes in the energising frequencies fed to it, and so retains the "directional" characteristics originally designed into it.

In principle, a transducer whose effective dimensions could be varied as a function of frequency might be used to great advantage in those situations where it is desirable to control directional characteristics (which includes all the examples quoted above). The invention described herein enables the construction of transducers which have an effective size which decreases as frequency increases (and wavelength decreases). Of particular interest is the case when the transducer maintains a constant ratio of effective size to the wavelength of sound, even when frequency is varied. This condition means that the transducer will maintain constant beamwidth as frequency varies.

To produce such a transducer there is required a sensitive element with some way of differentiating between the signals arising at different areas of the transducer face, so that different weightings could then be applied to different areas at different frequencies, and the manner in which the element responded—for instance, moved or flexed to produce a sound—would correspondingly differ (in a frequency-related manner) depending on which part of the element was involved. It is well known that this type of differentiation can be achieved by using an array of small transducers that can act rather like a single large transducer, and then quite separately (and externally of the transducer system itself) electronically weighting in some frequency-dependent way the signals for each individual small transducer. The invention herein disclosed, however, is a single transducer (which may be either a receiver type such as for use in a microphone or a transmitter type such as for use in a loudspeaker), not needing complicated external processing, yet having the desirable feature of controlled (including the special case of constant) beamwidth as a function of frequency. More specifically, the invention proposes that there should be used an active element—the "diaphragm" component of the transducer—that permits automatic frequency-sensitive control of the beamwidth by "shading" the local response of that signal across the face of the element, using a resistive coating in association with a capacitive layer (through which the currents representing that signal travel) such that the CR value of the combination varies over the surface of the element.

SUMMARY OF THE INVENTION

The novel feature of the present invention is to employ the interaction of an electrically-resistive electrode with the capacitance of either the sensitive material itself (as in the case of piezoelectric transducers, described hereinafter), or with the capacitance provided by an otherwise inert or insensitive dielectric layer (as in the case of the novel ribbon loudspeaker also described hereinafter). The resistive electrode has to be designed to interact with the capacitance of the dielectric layer to produce the correct shading of the input to or output from the device as a function of frequency. It is the displacement currents flowing through the capacitive element which provide the frequency-dependent characteristics of the shading (a simple resistive electrode, with current flowing between connections made at different points cannot provide any frequency dependence, nor can a dielectric coating employed merely to reduce electric field strength in a sensitive piezoelectric element), and design equations enabling the calculation of the appropriate surface resistances and capacitances to achieve different frequency-dependent shading functions are given hereinafter.

In one aspect, therefore, the invention provides, for use as the active element of an acoustic transducer, permitting the directivity of the transducer to be controlled as a function of frequency, a multilayer device comprising:

an area-extensive layer of a dielectric, capacitive material having adjacent one face a layer of an electrically-resistive material and adjacent its other face a layer of an electrically-conductive material, there being electrical connections made both to the conductive layer and to the resistive layer such that an electrical signal may be fed thereto or extracted therefrom; and wherein one or both of the capacitance per unit area (C) of the dielectric layer and the resistance (R) of the signal path through the resistive layer is tailored as a function of position across the element in order to produce a position-dependent CR (time constant) value that provides the element with the desired frequency-responsive directional characteristics.

The details of the invention, and its more preferred embodiments, are discussed below; first, however, there is considered the invention's apparent similarity with but significant difference from the known Art.

The invention uses the interaction of a resistive electrode with a capacitive dielectric layer to provide a frequency-dependent shading function which modifies the response over the face of the transducer. Attempts to control some directional characteristics of transducers by the use of electrically-resistive or dielectric coatings on transducing elements have been made by various workers in the past. However, as noted above these have previously been aimed at reducing diffraction effects (sidelobes) arising from edge effects. The response of these transducers is shaded (sometimes referred to as "apodised"), providing some form of reduced response towards the edges of the transducer. Some of the embodiments of these earlier ideas can look superficially similar to the embodiments of the present invention described in this Specification. However, these previous attempts invariably use the variation of voltage between two or more connections made to a resistive layer to "shade" the voltage applied to the sensitive element, or the ability of a dielectric coating to reduce the electric field strength at the edges of piezoelectric transducers. Although it can be very effective at reducing the diffraction effects which produce sidelobe responses, this form of directivity control produces a constant shading—a shading that is constant regardless of the frequency of the signal—and does not allow the transducer to achieve different effective dimensions at different frequencies. By contrast, the main novel and inventive feature of the present invention is the interaction of an electrically-resistive electrode with the capacitance of either the sensitive material itself (as in the case of piezoelectric transducers), or with the capacitance provided by an otherwise inert or insensitive dielectric layer (as in the case of the novel ribbon loudspeaker described below), to control the width of the main beam of the directivity characteristic. Any effects that the invention has on the diffraction effects or sidelobe levels is purely coincidental. It is shown later that sidelobe levels can also be reduced by the invention, but this is not the main purpose of the invention.

The device of the invention is for use as the active element of an acoustic transducer. As exemplified hereinafter, the transducer may be one that converts electrical energy into sound energy—a loudspeaker (or projector, if to be used under water)—or it may be one that does the opposite, and converts sound into electricity—a microphone (or hydrophone, if used under water). The sound energy involved may be sound of any frequency—subsonic, normal audio, or ultrasonic.

The invention's device, when used as the active element of an acoustic transducer, permits the directivity of the transducer to be controlled as a function of frequency. More specifically, by carefully designing the way that the element's CR (time constant) value changes over the active area of the element, so the transducer may be made to have constant (or perhaps predictably variable) directivity as the frequencies it converts are changed—perhaps remaining omnidirectional or instead having a defined beamwidth, as required. The mathematical constraints involved in suitably designing the element to achieve these sorts of end are discussed in more detail hereinafter.

The active element of the invention is a multilayer device comprising a layer of a dielectric, capacitive material having adjacent one face an electrically-resistive material and adjacent its other face a layer of an electrically-conductive material. While a three-layer device—one capacitive layer, one resistive layer, and one conductive layer—is perfectly satisfactory for many purposes, particularly where the transducer is for use as a microphone or the like, the performance of the element, especially for utilisation as a sound projector of the type required for a SONAR system, may be considerably improved by replicating the layers rather like a double- or triple-decker sandwich, and then arranging the individual adjacent elements in a back-to-back disposition, with like layers touching (for example, the conductive layer of one contacting the conductive layer of the next, or the resistive layer of one contacting the resistive layer of the next), and oppositely polarised. In actually constructing such a multiple-element device the touching layers may, conveniently, be "combined" into what is effectively a single layer. One such improvement is to achieve greater capacitance with thinner, multiple dielectric layers, and so perhaps permit lower resistance values, while another, when using a piezoelectric capacitance layer, enables there to be used not only lower voltage signals (the piezoelectric effect is dependent on the voltage gradient in the material) but also a greater volume of piezoelectric material, this improving the power-handling capacity of the device. Thus, for example, there may be a plurality of capacitive layers between the appropriate conductive and resistive layers (to each of which latter an appropriate electrical connection is made). Typically, such a replicated layer structure might have as many as a dozen conductive/capacitive/resistive layer triplets.

The individual layers making up the invention's device may be formed of any appropriate material and have any suitable dimensions (thickness and length/breadth) and shape, as determined by the operating frequency range (and wavelength range) of the device, and more is said about this hereinafter. Here, though, it is worth noting that in general transducers for operating at the higher frequencies, in the ultrasound region, are smaller—of the order of a few millimeters across—than those for operating at lower frequencies, down to a few tens of Hertz—which are possibly as large as a few meters across. Layer thicknesses, however, tend not to be frequency-related but rather power-related; overall, however, the layer thickness can vary from that of a mono-molecular coating as produced by vacuum-deposition techniques (in the region of 0.01 micrometer thick), which might be satisfactory in a condenser microphone, to several millimeters (or even centimeters: see the description hereinafter relating to a hydrophone embodiment).

The capacitive dielectric layer will most usually be a solid but flexible dielectric material like a plastics substance such as a polyvinyl chloride (PVC) or a polyvinylidene fluoride (PVDF), a polyethylene or polypropylene, or a melamine. Alternatively, a layer of a solid material such as a silicon oxide or a tantalum oxide, or a "dielectric ink" (such as that available as ELECTRODAG 6018SS from Acheson Colloids), can be used, supported on some appropriate substrate, or a solid but rigid self-supporting material, such as a (piezoelectric) ceramic like barium titanate or lead zirconate titanate (PZT), can be employed in some designs. For certain purposes, however, as exemplified by a condenser microphone or electrostatic speaker, the capacitive layer may be simply a gap filled by the ambient fluid (typically a gas such as air). Where the capacitive layer is a solid, it is convenient for the resistive and conductive layers actually to be supported thereby—indeed, to be bonded thereto.

Where the element's capacitive layer is or includes a solid active material such as a piezoelectric layer, and this is made of a stiff (i.e., not locally-reacting) material such as a ceramic, the layer may be tessellated—in a chequerboard pattern of smaller units, or "tesserae"—so as to render the material locally reactive in that each individual smaller part of the element will act independently of the other parts. This class of transducer not only includes types where completely-separated piezoelectric elements are placed on a resistive layer but also those where an initially-formed single large element is subsequently "sliced" into smaller parts by cuts made normal to its face (which includes those wherein the cuts penetrate only part of the thickness of the piezoelectric layer).

The capacitive layer may be inactive, being used only for its dielectric, capacitive effect (as is the case with the air gap in a capacitive microphone or speaker). However, the layer may be "active", in the sense that the layer is used not merely to provide a capacitance effect but also actually to be responsible for the motion which produces the energy conversion process. Thus, for example, in a loudspeaker transducer the capacitive layer may be made of a piezoelectric material that moves/flexes/changes shape when a voltage is impressed across it, and thus, this movement causing the generation of compression waves in the surrounding medium, in so doing actually converts the input electrical energy into an acoustic output. Again, in a hydrophone the capacitive layer may be made of a piezoelectric material that produces electrical signals when acted upon by sound pressures in the ambient liquid. PVDF is a piezoelectric plastics material that can be utilised in these ways. There may even be occasions when there can be employed two (or more) capacitive layers, one being of a simple, inactive dielectric and the other being an active material (such a combination might be desirable if the dielectric permittivity required of the layer is more than can conveniently be provided by the available active materials but is achievable using an inactive material). For example, a piezoelectric element of very low capacitance might require very high surface resistances in a resistive electrode designed to make it exhibit frequency independent beamwidth. In this case a separate resistive/dielectric/conductive-layered composite might be applied to its rear surface, with the resistive layer in contact with the piezoelectric material.

In such an active-layer element it is the frequency-dependent shading of the electrical voltages in the resistive layer that allows directivity control. In some passive-layer elements, such as the tape positioned in the magnetic fields within the novel form of ribbon speaker described further hereinafter, it is the shading of the currents in the resistive layer which, interacting with the magnetic field, permit the required directivity control.

The device of the invention is a transducer active element that permits the directivity of the transducer to be controlled as a function of frequency, and this is achieved by having resistive and capacitive layers such that one or both of the signal pathway resistance of the resistive layer and the capacitance per unit area of the dielectric layer is tailored as a function of position across the element in order to produce a position-dependent CR (time constant) value that provides the element with the desired frequency-responsive directional characteristics. This is discussed in more detail—and with mathematical treatment—hereinafter; for the moment two points are perhaps worthy of note. Firstly, in what is possibly the simplest case of a transducer device of the invention, the resistivity of the resistive layer is uniform across that element, and it is the mere resistance of the signal pathway to the connection point which provides whatever degree of position-dependence may be required. Secondly, any required variation in the capacitance afforded by the capacitive layer may be achieved by, for example, changing either the dielectric property or the thickness or physical disposition of the layer in an appropriately position-dependent manner. Thus, the dielectric property of the layer could be changed by varying the chemical/molecular composition of the material, or by varying the physical composition (as by laying down a pattern of different materials, such as a high dielectric-constant material interspersed with another material—possibly air—of lower permittivity).

Ignoring any changes in thickness relating to the necessary CR changes, the individual capacitive layer thickness can vary from that of a mono-molecular coating as produced by vacuum-deposition techniques (in the region of 0.01 micrometer thick) to several millimeters or even centimeters. Extremely thin layers find a use in devices where very high capacitance is required, or where the device has to be very small so as to be responsive to very high frequencies, such as is often the case in ultrasound imaging and in apparatus for use in non-destructive testing. In contrast, very thick layers will be of value in high-power devices, such as are needed in SONAR projectors. In a replicated layer structure the individual capacitive layer thicknesses would be governed by the same constraints, but the overall thicknesses might be somewhat greater in most typical designs.

Adjacent one face of the (or each) capacitive layer employed in the element of the invention is the required electrically-resistive layer. This layer may be formed of any suitable resistive material, and may be constructed and retained on or adjacent the face of the relevant capacitive layer in any appropriate way. Typical resistive materials are carbon-bearing resins (typically any of the available epoxies or phenolics loaded with carbon), very thin vacuum-deposited metal films (conveniently using nichrome or gold as the metal), and printed-on "conductive" inks or pastes (such as any of the available ones, which each tend to be a polymer matrix carrying either graphite or a metal such as silver or nickel in particulate form; Acheson Colloids supplies a carbon-loaded and a silver-loaded paste under the names ELECTRODAG 6016SS and 473SS respectively). The layer of this material may be supported or formed directly on the capacitive layer (if the latter is solid), while if the capacitive layer is, say, simply an air gap then the resistive layer can be formed on some other, solid, insulating support (this is the case in the microphone example mentioned above and discussed in more detail hereinafter with reference to the accompanying Drawings).

Ignoring any changes in thickness relating to the necessary CR changes (this is discussed further hereinafter), the thickness for the individual resistive layers can vary from that of a mono-molecular coating as produced by vacuum-deposition techniques (in the region of 0.01 micrometer thick) to several millimeters (or even centimeters). Very thin resistive layers will be required in devices which have low capacitance, such as condenser microphones, while thick resistive layers are required for devices that handle considerable amounts of power, such as a SONAR projector. In a replicated layer structure the individual and overall thicknesses for the resistive layers would be governed by the same sort of constraints as noted above for the capacitive layers.

Adjacent that face of the (or each) capacitive layer opposed to the respective resistive layer is the required electrically-conductive layer. Although usually this conductive layer will in fact be a layer of a good conductor—a layer of a material having a high electrical conductivity—and for the most part hereinafter the device of the invention is discussed as though this were the case, it is in fact possible for the conductive layer to be more like the resistive layer, and thus be a poor conductor of electricity, provided that it does permit electrical signals to be delivered to or picked up from the capacitive layer. Of course, in embodiments where the conductive layer is indeed a second resistive layer it, too, may take a part in the tailoring of the device's CR value to provide the required control of beamwidth in dependence on signal frequency. An instance of this is discussed further hereinafter with reference to the accompanying Drawings.

The conductive layer may be formed of any suitable conductive material, and may be constructed and retained on or adjacent the face of the relevant capacitive layer in any appropriate way. Thus, the conductive material may be a suitably-supported conductive ink or metal-loaded resin (an appropriate ELECTRODAG material, for instance) but is preferably a metal such as aluminium, gold, copper or silver. The layer of this material may be supported or formed directly on the capacitive layer (if the latter is solid), while if the capacitive layer is, say, simply an air gap then the conductive layer, if it is not self-supporting, can be formed on some other, solid, support.

A typical thickness for the conductive layer is 0.1 mm, but a suitable range of thicknesses would be from 0.01 mm to 1 mm. In general, though, the layer thickness can vary from that of a mono-molecular coating (in the region of 0.01 micrometer thick) to several millimeters (or even centimeters).

Overall sizes and shapes for the device of the invention may be almost anything thought desirable. In a microphone the element might be a disc from several millimeters to several centimeters diameter, while in a conventional loudspeaker the element might be a disc or rectangle from several centimeters across to perhaps a meter or more (and in a typical ribbon speaker design the element might be a ribbon or tape in the tens of centimeters long and several millimeters wide).

The device of the invention, used as the active element of an acoustic transducer, permits the directivity of the transducer to be controlled as a function of frequency. This is achieved by arranging that one or both of the signal pathway resistance of the resistive layer and the capacitance of the dielectric layer is tailored as a function of position across the element in order to produce a position-dependent CR (time constant) value that provides the element with the desired frequency-responsive directional characteristics. This is discussed below in more detail; here, though, it can be said that a change in surface resistance (achieved by suitably forming the resistive layer so that either its composition or its thickness or physical disposition changes appropriately) such that the resistance per unit distance falls linearly outwards from the element's centre can be employed to produce the desired directionality—perhaps retaining omnidirectionality or alternatively a constant beamwidth—over a restricted but suitably-wide frequency range (a similar effect can be achieved by correspondingly altering the capacitance of the dielectric layer). In one example, the resistance is altered by forming it as a network—a pattern of holes within a web of poorly-conductive material—of which the ratio of holes to material changes appropriately with distance from the unit's centre. In another, shown in the accompanying Drawings, the layer's unit resistance is reduced by progressively thickening it outwardly from its centre.

It was the advent of locally-reacting transducing materials (such as the piezoelectric plastic polyvinylidene fluoride) that originally inspired the concept of the present invention, and the simplest embodiment of the transducer element of the invention would be a disc-like layer of a piezoelectric material such as PVDF metallised on one side and with an electrically-resistive layer on the opposite side to the centre of which is made a single electrical connection (such a case is diagrammatically illustrated in FIG. 1 of the accompanying Drawings). The capacitance per unit area of such a constant-thickness device would be everywhere the same. The resistance from the single connection point, however, is greater to the extremities of the disc than it is to points near to the central connection. Each part of the transducer element therefore has a different CR value. The effect of each part of the element being a CR circuit is that the nett contribution to the total response of any particular part of the element will be reduced by an exponential factor determined by the product of the frequency and the CR value (ie, of the form $e^{\omega RC}$), in much the same way as that of an ordinary capacitor/resistor circuit. Since the CR values for the parts at the extremities of the element are greater than those for the parts near the central connection, the response of these further parts will reduce more rapidly as frequency is increased; in other words, the effective size of the transducer element will "shrink" as frequency is increased. The same principle can of course be applied to transducing elements where the capacitive layer is other than piezoelectric (e.g., capacitive "electrostatic" elements). In this way the invention provides a means of "shading" the response over the face of a transducer element as a function of position. This shading also varies as a function of frequency, in order that the directivity of the transducer may be controlled over a defined bandwidth.

A transducer element may be created by using a piezoelectric material as the capacitive layer, or by using a simple non-active dielectric material as the capacitive layer together with an active material layer (e.g., a piezoelectric plastic or ceramic layer) both in contact with the resistive layer. Moreover, since the currents flowing in the resistive layer are shaded in the same manner as the voltages, a transducer element can also be constructed by placing the capacitive/resistive composite in a magnetic field (as in a ribbon loudspeaker).

The desired control of directional properties is determined by shaping the way the CR time value varies with position. As noted above, perhaps the simplest way of effecting this CR variation is merely to ensure that the signal pathway resistance vary linearly with distance from the connection point. If, however, more variation than this is required, then it is perhaps simplest to arrange that the electrical resistance per unit length of the resistive layer vary suitably with its distance from the connection point, by for example varying either the physical disposition, thickness or composition of the layer. However, the capacitance per unit area of the dielectric layer could equally well be varied, as a function of position, by appropriately varying the thickness of the dielectric, its physical disposition—in a pattern of spaced lines or a network or holes—or even the material's chemical composition.

The most sensitive area of the transducer element is centred around the connection to the resistive layer. In the simplest embodiment a single such connection is made, at the centre of the element, but it is quite feasible to employ instead what is much like an array of smaller elements arranged side by side—thus, many such connections can be made disposed over the entire surface of an area-extensive composite element. In such an array each "mini" transducer element is located around its own connection point. Extending this concept, it will be seen that the capacitive layers of such an array could be combined into a single, continuous layer, while the resistive layers could remain as individual items. Going further, groups of the individual resistive layer items that have the same resistance could be partially combined, as in narrow concentric rings, each provided with its own connection. Extending this still further, the resistive layers could be made a continuous whole, but with a multiplicity of individual connections disposed over its surface (an instance of this is discussed further hereinafter with reference to the accompanying Drawings). And taking the concept to its logical conclusion, it will be seen that it is possible, provided the resistivity of the resistive layer is suitably tailored, to provide a continuous conductive electrode over a continuous resistive layer, so forming what is is effect an infinity of infinitely-small elements arranged side by side (this realisation of the invention shares with the earlier version discussed above a simple electrical duality, in that one resistive electrode is a series and the other a parallel version of the same circuit). An instance of this is discussed further hereinafter with reference to the accompanying Drawings.

In any "array"-type element the effective size of the individual small portions can be larger than their spacing (i.e., the small portions can overlap each other). Moreover, in any "array"-type arrangement both the individual small portions may be CR-controlled, by suitably varying the resistivity or capacitance of each across its surface, as well as the array as a whole being CR-controlled.

To enable a better understanding of exactly what is involved in constructing a transducer element of the invention, there is now given a mathematical description of an example of a simple transducer of the loudspeaker type having resistive and dielectric layers which are spatially uniform.

Consider a one-dimensional transducer element of this type having an AC voltage applied to its connections. Current will flow in the electrically-resistive layer, outward from the connection point. Displacement currents will also flow through the capacitive layer.

The rate of loss of current from the resistive layer to the capacitive layer is:

$$\frac{di(x)}{dx} = -j\omega C'V(x) \tag{1}$$

and the voltage at any point x in the resistive layer is given by $$\frac{dV(x)}{dx} = -R'i(x) \tag{2}$$

where:

R'=resistance/unit length of the resistive layer; and

C'=capacitance/unit length of the dielectric layer (1) and (2) have solutions of the form $$i=ae^{-\alpha x} \quad (3)$$

$$V=be^{-\alpha x} \quad (4)$$

Note that both the current and the voltage in the resistive layer are shaded in the same way. Substituting (3) and (4) back in (1) and (2) gives $$-a\alpha=-bj\omega C'$$

$$-b\alpha=-R'a$$

i.e.

$$\alpha=\pm\sqrt{(j\omega C'R')} \quad (5)$$

In the case of a two-dimensional transducer, the equations equivalent to (1) and (2) involve:

i=current density in the layer (amps/unit width)

C'=capacitance/unit area

R'=surface resistivity (=volume resistivity/thickness)

Their solution is similar, except that it involves Bessel functions instead of complex exponentials. The argument of these Bessel functions is the same, however, and so the length scale of the "shading" function corresponding to equations (3) and (4) is approximately the same as the simpler case analysed here.

Equation (5) implies that the shading function created by simple layers of spatially-uniform dielectric and resistive materials varies on a length scale proportional to $1/\sqrt{\omega}$. To maintain constant directional characteristics this would require the length scale to be proportional to $1/\omega$, so that the effective size of the transducer would halve for each doubling of frequency. To achieve this it is necessary to add some shading by altering the properties of one (or both) of the dielectric/resistive layers. A convenient method is to vary the resistivity of the resistive layer. It turns out that for this special case the resistance/unit length, or in the case of a 2-dimensional transducer the surface resistivity (R'), needs to vary inversely with position (see Appendix).

$$\text{i.e.} \quad R'(x)=\frac{R'_0}{x}$$

This can be achieved either by thickening the resistive layer toward the outer extremities, or modifying the electrical properties of the material.

Note that the directional properties of such a transducer will be the same for its use as either a transmitter (speaker) or as a receiver (microphone).

The invention provides a means of controlling the directional characteristics of certain acoustic transducers. The invention will be applicable in areas where the requirement is for transducers with controlled directional characteristics and wide bandwidth. Applications in SONAR, Hi-Fi loudspeakers and microphones, ultrasonic transducers and underwater communications are envisaged.

BRIEF DESCRIPTION OF THE DRAWINGS

The invention will now be described, though by way of example only, with reference to the accompanying diagrammatic Drawings in which.

Figure 1:
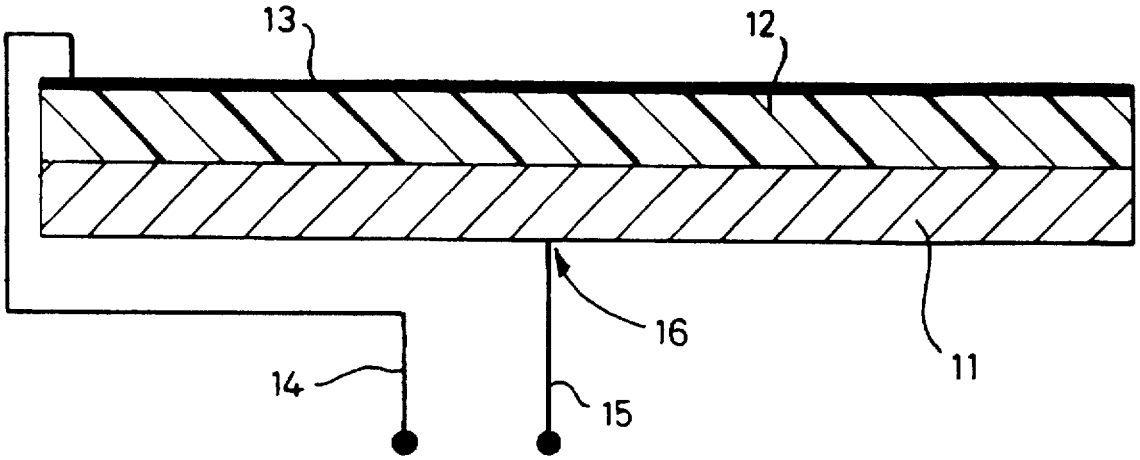
FIG. 1 is a schematic drawing of a device according to the invention.

The device shown in FIG. 1 is a transducer element according to the invention. It consists of three layers: an electrically-resistive layer (11) of constant thickness and uniform resistivity; a dielectric layer (12) of constant thickness and uniform dielectric constant; and an electrically-conductive layer (13) of constant thickness and uniformly-high conductivity. Connections (14, 15) are made to the conductive layer 13 (near the latter's edge, although the actual position is not important) and to a point (16) centrally-located on the resistive layer 11.

The capacitance per unit area of such a spatially-uniform device is everywhere the same. The resistance from the single connection point 16, however, is greater to the extremities of the disc than it is to points near to the central connection point, and therefore parts at greater distances from that point have a different CR value. The effect of each part of the element being a CR circuit is that the nett contribution to the total response of any particular part of the element reduces most rapidly as a function of frequency where the CR value is highest. Since the CR values for the parts at the extremities of the element are greater than those for the parts near the central connection, these further parts will be the first to show lower responses as frequency is increased; in other words, the effective size of the transducer element will "shrink" as frequency is increased (this is discussed further hereinafter with reference to FIG. 5).

Figure 2:
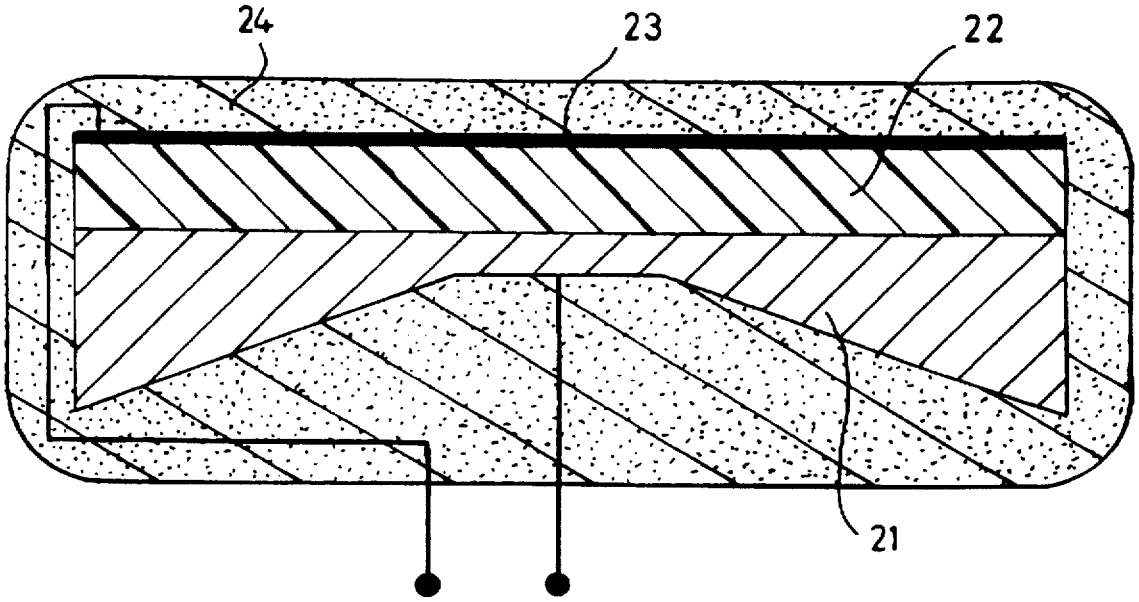
FIG. 2 shows an embodiment of the invention applied to an underwater transducer.

The device of FIG. 2 is an embodiment of the invention applied to an underwater transducer. This embodiment utilises a resistive layer (21) with a surface resistivity which is tailored to fall toward the edges of the transducer (by thickening the resistive layer toward the edges, as is clearly shown) and a piezoelectric material as the dielectric layer (22). The piezoelectric layer is metallised with silver on one side only to form the conductive layer (23). The transducer is waterproofed with a suitable potting compound (24: shown dotted). A fuller description of this embodiment, including design calculations, is given below under the heading "Description of a preferred embodiment".

Figure 3:
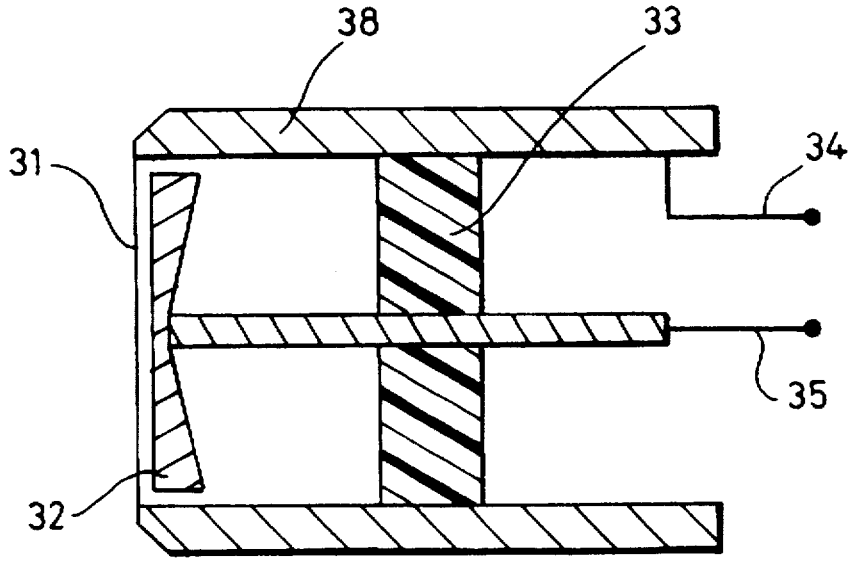
FIG. 3 shows another embodiment of the invention in the form of a condenser microphone.

FIG. 3 shows an embodiment in the form of a condenser microphone. A thin conductive diaphragm (31) forms one plate of a capacitor, the other plate (32) consisting of an electrically-resistive material whose surface resistivity falls linearly from the centre of the transducer toward the edges. The plate 32 is supported in a position parallel to the diaphragm plate 31 on an insulator (33). Connections (34, 35) are made to the microphone at the centre of the resistive plate 32, and, via the conductive case (38) of the microphone, to the diaphragm 31. Suitable choice of resistivity values for the back plate 32, using the same design formulae as those for the preferred embodiment below, can produce a microphone which retains omnidirectionality over a much wider bandwidth than a similar condenser microphone not embodying this invention.

Because the capacitance of such a microphone would normally be quite low (perhaps just a few tens of picoFarads) the surface resistances required in plate 32 can turn out to be large (of the order of Megohms per square). Such surface resistances are best achieved by using vacuum-deposited metals, such as "nichrome", which can be laid down on an insulating base to form the back plate of the microphone.

Figure 4:
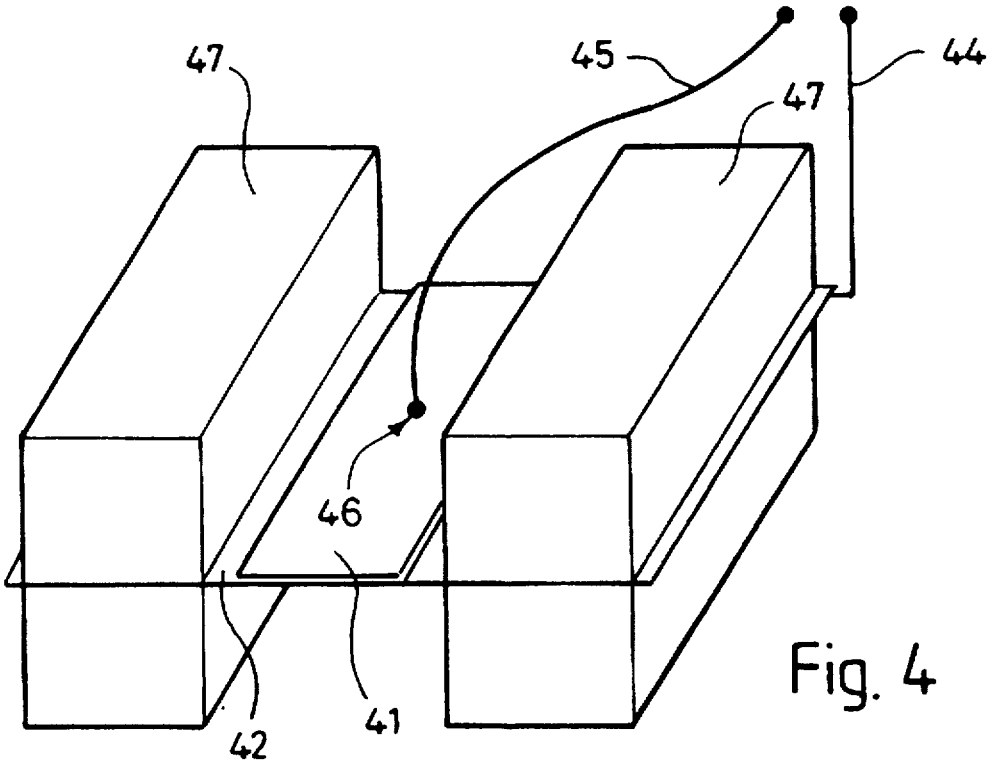
FIG. 4 shows another embodiment of the invention in the form of a ribbon loudspeaker.

FIG. 4 is another embodiment of the invention, this time in the form of a ribbon loudspeaker. A thin plastic membrane, or ribbon (42), is held between the pole pieces of a permanent magnet (47) so that the direction of the magnetic field is across the narrow direction of the ribbon. The ribbon is metallised (not shown) on one side, and carries a resistive layer (41) on the other side. The silvered membrane is carried out through the pole pieces, and one of the transducer's connections (44) is made to the silvered layer outside the magnetic field. The other transducer's connection (45) is made at a point (46) in the centre of the resistive layer, though it could equally well be made by a metallic strip across the width of the ribbon.

Currents flowing from the central connection 45, 46 into the resistive layer are shaded according to the principles described earlier. The displacement currents flowing to the silvered layer, through the capacitive (dielectric) layer 42, take the shortest route to the electrode 44 connected to the silvered layer, and thus flow in a direction parallel to the magnetic field. This ensures that only those currents flowing in the resistive layer 41 produce a force to drive the membrane 42 and provide sound.

To ensure that currents in the silvered layer can only flow in a direction parallel to the magnetic field, the silvered layer can be laid down in strips across the membrane and the external connection to the silvered layer can be made via a thick "bus-bar" along the edge of the membrane. Because the construction of a typical ribbon loudspeaker would be much longer and thinner than that illustrated in FIG. 4, these measures are not always necessary.

Figure 5:
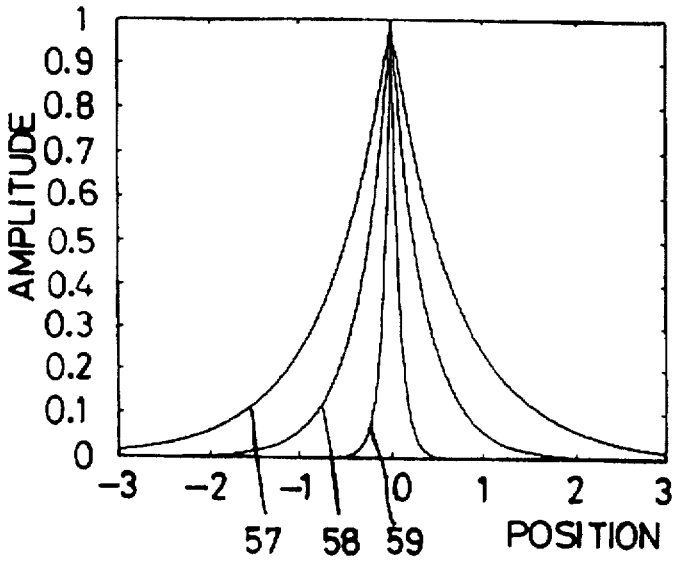
FIG. 5 is a graphical representation of how the effective size of the simple transducer of FIG. 1 changes as the signal frequency changes.

The graphical representation of FIG. 5 shows for a transducer of the FIG. 1 type the amplitude of the motion on the surface of the transducer (the vertical, or Y, axis, between 0 and a maximum arbitrarily designated 1) as a function of distance from the central connection (the horizontal, or X, axis, ranging from an arbitrary value of 3 on one side to −3 on the other). Three results are shown, for excitation frequencies in the ratios 1:4:16 (a four-octave range), the broadest pattern (57) corresponding to the lowest frequency, the narrowest (59) to the highest. It will be noted that the width of the displayed pattern halves for each two-octave, or quadrupling of frequency, change (the mathematical analysis presented herein shows that the width of the response pattern should be proportional to the square root of frequency). If instead there were used a plain PVDF material silvered on both sides, as is usual, there would be no variation of response with frequency, even in those transducer types which have been "apodised" to reduce edge effects.

Figure 6:
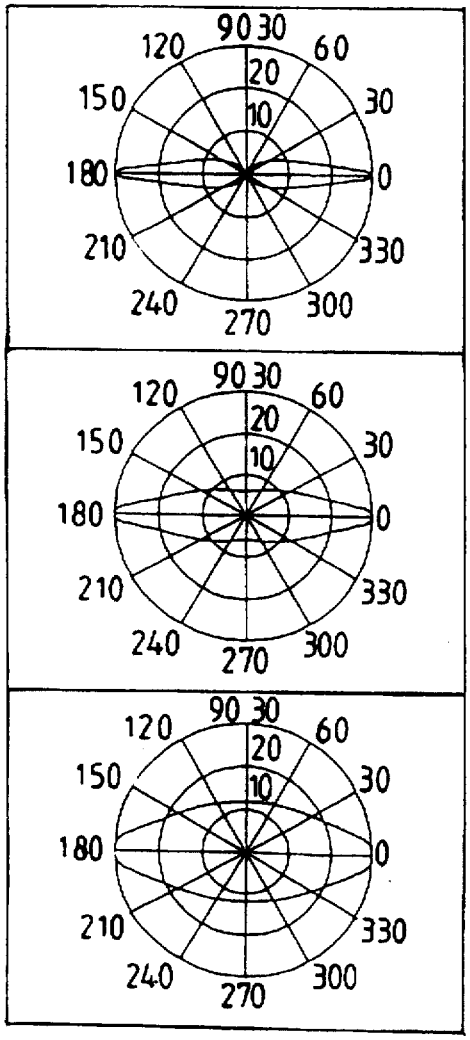
FIGS. 6 & 7 are polar diagrams for respectively the simple FIG. 1 transducer and a conventional piston transducer, showing how the directional response changes with signal frequency.

The directional properties of the sound field created by the simple transducer illustrated in FIG. 1 are shown in FIG. 6, which presents graphically three directivity patterns calculated from the Helmholtz integral of the shapes given in FIG. 5. Each graph is a polar plot, with response being indicated by the distance from the origin (and plotted on a logarithmic scale, over a range of 30 decibels; the circles are at 10 dB intervals). The plots show that the width of the main beam varies approximately as the square root of the frequency; the narrowest beam corresponding to the highest frequency and the broadest to the lowest frequency.

It will be seen from the FIG. 6 plots that there are no sidelobe responses; this is because the simple exponential shape of the spatial distribution of motion on the transducer face (as illustrated in FIG. 5) does not suffer the edge effects which produce sidelobes. This is not the primary purpose of the invention, however, and is simply a spin-off benefit which could as easily have been obtained from a constant (frequency-independent) shading function which could be provided by (simpler) conventional means. However, the modification of the width of the main beam is not the same as would be obtained from more conventional transducers. As can be seen, the beamwidth halves for each quadrupling of frequency (i.e., it is inversely proportional to the square root of frequency). The conventional transducer (apodised or not) would change its beamwidth in inverse proportion to the frequency, as is shown by the comparable polar diagrams of FIG. 7, which relate to a simple piston transducer going from a practically omnidirectional response to a narrow beam over the same range of frequency change. The sidelobes associated with a simple non-apodised piston transducer, although not relevant to the purpose of the present invention, are also shown here.

Figure 7:
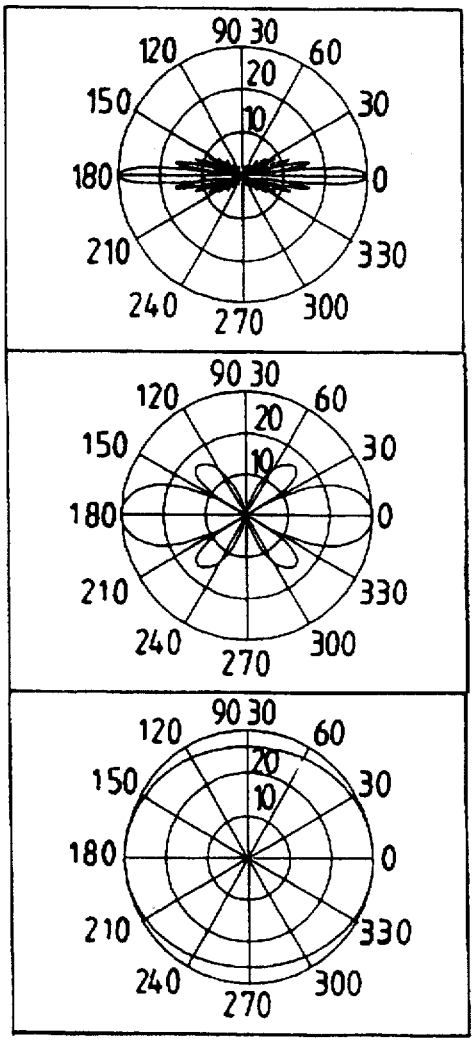

Summarising the import of FIGS. 6 and 7, they show that, while a conventional transducer approximately doubles its beamwidth for a mere one-octave change in frequency, the main beam of even this simple transducer of the invention will not double its width until there has been a full two-octave change in frequency. This significant reduction in sensitivity of the beamwidth to frequency changes in the transducer of the invention can be improved even more by further tailoring the properties of the dielectric and/or resistive layers in the device's active element. Indeed, as is the case of the hydrophone preferred embodiment described in more detail hereinafter, the transducer can be provided with a beamwidth which is effectively independent of frequency over a wide range of frequencies.

It should be noted, incidentally, that the transducer corresponding to the invention would have to be larger than the conventional transducer to behave in this manner—it is not possible to maintain a narrow beamwidth at low frequencies without a suitably large aperture. The point being made is that the invention provides a lower sensitivity to frequency changes in the directivity patterns.

Figure 8:
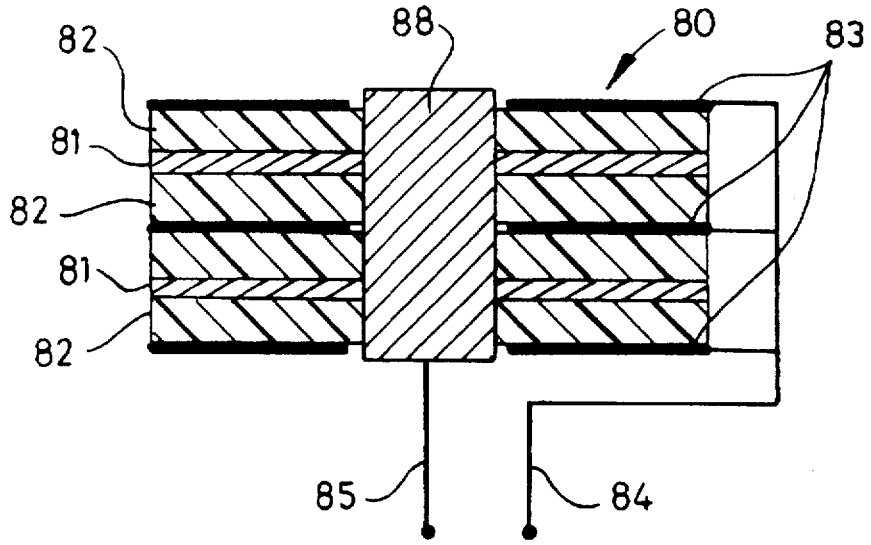
FIG. 8 shows a transducer of the invention made from a stack of individual transducer elements.

The transducers of the invention, particularly the piezoelectric varieties, can be combined to form a transducer stack as is common practice with conventional transducers (particularly SONAR transducers). In this case it is possible to make the stack of interleaved conducting layer/piezo layer/resistive layer units, and each conductive and resistive layer will then serve to drive two piezoelectric layers, as is illustrated in FIG. 8 (note that alternate piezo layers need to be poled in opposite directions).

The resistive layers (as 81) are brought to a common connection (85) at the centre of the stack (80) of individual transducer elements through a central connector element (88) passing through a hole through the centre of the stack (the central connector 88 may typically be a threaded bolt used to clamp the individual elements together). The conductive layers (83) are also connected together, and brought out to a second connection (84), but are insulated from the central connector 88 by virtue of the fact that they stop short of the central hole. The piezoelectric layers (82) are polarised in opposite directions on either side of the resistive layers.

This construction is common in existing piezoelectric transducer designs, but there the resistive layers would be simple conducting layers instead (and of course there is no directivity control associated with such conventional designs).

Figure 9:
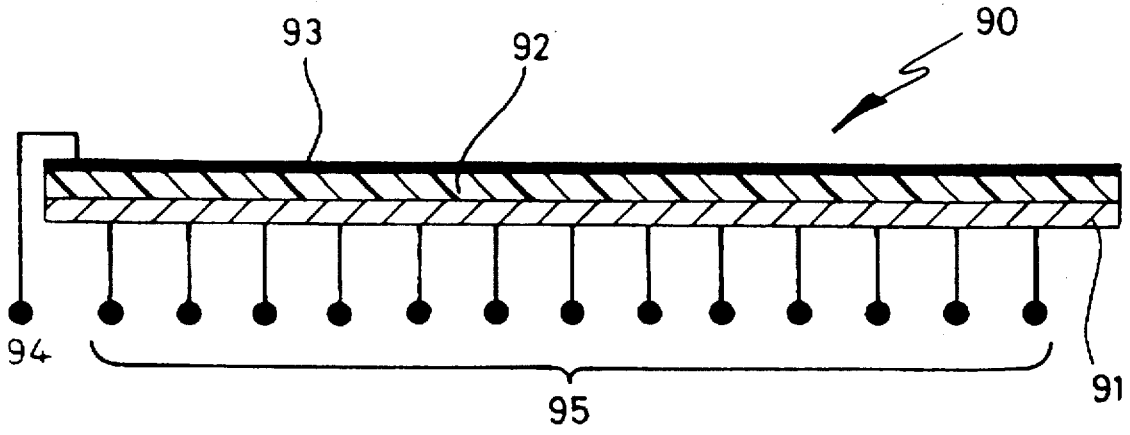
FIG. 9 shows a transducer of the invention in the form of an area-extensive array of many smaller transducer elements.

The most sensitive area of a transducer constructed according to the invention is centred around the connection to the resistive layer. Many such connections can be made to an extensive composite, and an "array" of transducers is formed by such an arrangement, each transducer being located around its own connection point. Such a design is illustrated in FIG. 9, which shows how an area-extensive composite transducer (90) constructed according to the invention may be used to create an array of transducers by simply making multiple connections to the resistive layer. The composite consists of a resistive layer (91) in contact with a piezoelectric layer (92) which has a conductive layer (93) on the opposite side. A common return connection (94) is made to the conductive layer, and a series of connections (95) is made to the resistive layer. Each of the latter connections forms in effect an individual transducer in the array.

Such an array may be beamformed or otherwise processed in the same way that individual transducers forming a conventional array are.

It will be noted that by careful design of the resistive electrode and the capacitive layer, the individual transducers can be made to be independent (i.e. separated) or can overlap each other. It is also possible to have transducers which overlap at low frequencies, but behave independently at high frequencies. The frequency of transition between these two regimes can be controlled by designing the resistive and capacitive components with reference to the element spacing in the array, and the required operational bandwidth.

Figure 10:
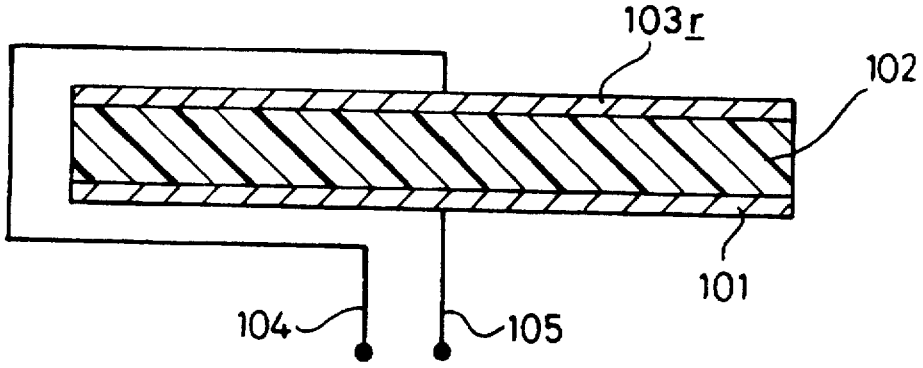
FIG. 10 shows a transducer of the invention utilising two resistive layers.

FIG. 10 relates to an embodiment of the invention wherein, rather than using the comparatively simple structure of a dielectric layer (102) with a resistive layer (101) on one side and a conductive layer on the other, the conductive layer is itself a resistive layer (103*r*)—so that there is a resistive layer on each side of the dielectric layer, with the appropriate connections (104, 105) to the centre of each. Naturally, in applying the relevant design formulae to such an embodiment there must be included the effect of the resistive "conductive" layer 103*r*.

Figure 11:
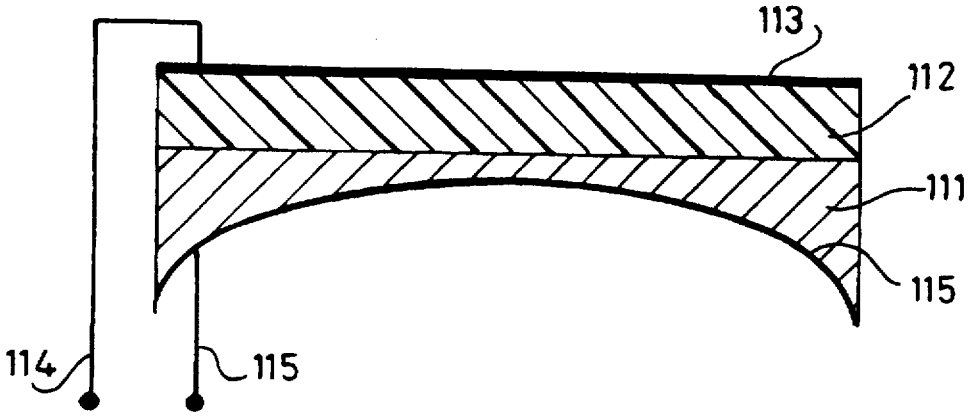
FIG. 11 shows a transducer of the invention using a sheet electrode to connect to the resistive layer.

The embodiment of FIG. 11 shows how the connection (115) to the resistive layer (111) may be made by way of an electrode (115*l*) covering the whole of the outer face of the layer, so that there is formed an electrode/resistive layer combination which is a "parallel" version of the more usual point-feed serial case.

In the embodiment shown, with a conductive layer (113), with its connection (114), on one side of the capacitive layer (112) and a varying-thickness resistive layer 111, and connection 115, on the other, the resistance through the resistive layer 111 to the outer parts of the dielectric layer (112) is higher than that to the more central parts because the resistive layer's thickness, and thus the signal pathway, increases towards its periphery; the way this resistance change is tailored provides the frequency response control desired.

Description of a Preferred embodiment

The embodiment of the invention shown in FIG. 2 is applied to the design of a transducer to operate in water in the frequency range 10 kHz to 100 kHz. The transducer is made as large as possible for sensitivity purposes, but it is required to maintain approximately 30° beamwidth over this frequency range.

The transducer is designed to have a resistive layer of constant surface resistivity over a radius corresponding to the required effective size at the highest frequency. Thereafter, the resistivity of that layer is reduced by thickening the layer towards the edges, to reach a value of resistivity corresponding to that required to maintain beamwidth at the lowest frequency. This can be obtained by altering the thickness of the layer linearly.

For this purpose of this example, it is assumed that the effective radius of the transducer is given by the distance over which the shading function of equations (3) and (4) above has fallen in amplitude from unity to 1/e. This implies the following formula for calculating the required resistivity of the resistive layer:

$$R' = \frac{2}{\omega C r^2} \tag{6}$$

where r is the effective radius (i.e., of an equivalent piston).

Now, the size of the equivalent piston transducer required to obtain a beamwidth of θ in radians (to the "half power" points) is given approximately by $$\theta = \frac{\lambda}{2r} = \frac{\pi c_p}{\omega r} \tag{7}$$

(where δ=wavelength of sound, and $c_p$=velocity of sound).

Combining (6) and (7) gives $$R' = \frac{2\omega\theta^2}{\pi^2 C c_p^2} \tag{8}$$

Now the resistive layer can be designed to meet the requirements of the transducer. Shading of the resistance characteristic is effected by altering the thickness of the layer. The capacitance of the piezoelectric layer is assumed to be 10 μF/m². The central portion of the layer is of constant thickness to the radius required to meet the highest frequency of operation (100 kHz). Then using (7), the radius r of this constant thickness part will be $$\begin{aligned} r &= \frac{\pi c_p}{\omega\theta} = \frac{c_p}{2f\theta} \\ &= \frac{1{,}500}{2 \times 100{,}000 \times \pi/6} \\ &= 0.0143 \text{ m} \end{aligned}$$

The surface resistance in this part, calculated according to (8) above, is $$\begin{aligned} &= \frac{2 \times 2\pi \times 100{,}000 \times (\pi/6)^2}{\pi^2 \times 10^{-5} \times (1{,}500)^2} \\ &= 1.55 \text{ k}\Omega \text{ per square} \end{aligned}$$

Outside this constant thickness region the thickness is increased linearly to meet the low frequency (10 kHz) requirement.

The overall radius of the transducer using (7) is 0.143 m, and the surface resistance near the outer edge is, by (8), 155Ω per square.

If there is chosen a material of specific resistivity of 1.55Ω then this implies a thickness of 1 mm for the central (constant thickness) region, increasing to 10 mm at the outer edges. The resulting design is that sketched diagrammatically in FIG. 2.

At this point it should be noted that the resulting directivity characteristics of this particular embodiment of the invention will suffer minor perturbations, particularly at the ends of the design frequency range, owing to "windowing" effects created by the finite size and sharp changes in the thickness of the resistive layer. These effects may be reduced by more subtle shading (i.e., shaping) of the resistive layer, possibly involving increasing the overall size of the transducer.

Appendix

It is required to solve the simultaneous differential equations $$\frac{di(x)}{dx} = -j\omega C'V(x) \quad \text{A1}$$

$$\frac{dV(x)}{dx} = -R'(x) \cdot i(x) \quad \text{A2}$$

and find some functional form for R'(x) which makes the functions V and i depend only on xω. Substituting (A2) in (A1) gives $$\frac{d}{dx}\left[\frac{1}{R'}\ \frac{dV}{dx}\right] = j\omega C'V \quad \text{A3}$$

To make the shading function V(x) depend only on xω this can be written as $$\omega\frac{d}{d(x\omega)}\left[\frac{\omega}{R'}\ \frac{dV(x\omega)}{d(x\omega)}\right] = j\omega C'V(x\omega) \quad \text{A4}$$

this will only be independent of ω if $R'=R'_0/x$, whence, writing xω=X $$\frac{d}{dx}\left[\frac{X}{R'_0} \cdot \frac{dV}{dX}\right] = j\omega C'V \quad \text{A5}$$

or $$\frac{X}{R'_0} \cdot \frac{d^2V}{dX^2} + \frac{1}{R'_0}\ \frac{dV}{dX} - j\omega C'V = 0 \quad \text{A6}$$

the solution to this equation is $$V=AI_0(2\sqrt{[jC'R'_0X]})+BK_0(2\sqrt{[jC'R'_0X]}) \quad \text{A7}$$

where A and B are constants and $I_0$ and $K_0$ are modified Bessel functions.

Note that this functional form has a singularity at the origin. Here, the resistance gradient would be infinite and the central connector would be insulated from the transducer! This is, of course, due to the fact that the mathematics is modelling a transducer which maintains constant beamwidth to arbitrarily high frequencies, requiring arbitrarily small effective size. Provided an upper frequency is specified, such a physically unrealiseable singularity will not be encountered.

I claim:

1. A multi-layer transducer device, for use as the active element of an acoustic transducer, permitting the directivity of the transducer to be controlled as a function of frequency, said device comprising:

an area-extensive triplet-layer element comprising a dielectric capacitive material with a first face having adjacent thereto a layer of an electrically-resistive material, and a second face having adjacent thereto a layer of an electrically-conductive material, there being electrical connections made both to the electrically-conductive material and to the electrically-resistive material such that an electrical signal may be fed thereto or extracted therefrom; and wherein one or both of the capacitance per unit area (C) of the layer of a dielectric capacitive material and the resistance (R) of the signal path through the electrically-resistive material is tailored as a function of position across the element in order to produce a position-dependent time constant value (CR) that provides the element with a desired frequency-responsive directional characteristic.

2. The multi-layer transducer device, as claimed in claim 1, comprising a plurality of said triplet-layer elements arranged as a replicated triplet-layer structure, each of said triplet-layers being disposed back-to-back with, and oppositely polarized to, its neighbors.

3. The replicated triplet-layer structure as claimed in claim 2, comprising up to twelve conductive/capacitive/resistive triplet-layers.

4. The multi-layer transducer device, as claimed in claim 1, wherein the capacitive dielectric layer is selected from the group consisting of a gas, a solid but flexible material, and a solid but rigid self-supporting material.

5. The multi-layer transducer device, as claimed in claim 4, wherein said gas is air, said solid but flexible material is plastic, and said solid but rigid self-supporting material is a ceramic.

6. The multi-layer transducer device, as claimed in claim 1, wherein, where the capacitive layer is a solid, and the resistive and conductive layers are physically supported thereby.

7. The multi-layer transducer device, as claimed claim 1, comprising an active capacitive layer, said active capacitive layer being adapted to provide a capacitance effect and a motion which produces the energy transduction process.

8. The multi-layer transducer device, as claimed in claim 7, wherein the capacitive layer comprises a piezoelectric material.

9. The multi-layer transducer device, as claimed in claim 8, wherein the piezoelectric material is a ceramic or polyvinylidenefluoride.

10. The multi-layer transducer device, as claimed claim 1, wherein:

the capacitive layer comprises a solid active material made of a stiff non locally-reacting material;

the capacitive layer is tessellated to divide the element into individual smaller parts and render each individual smaller part of the element independently reactive.

11. The multi-layer transducer device, as claimed in claim 10, wherein an initially-formed single large piezoelectric layer is subsequently sliced into smaller parts by cuts made normal to its face.

12. The multi-layer transducer device, as claimed in claim 11, wherein the cuts penetrate only part of the thickness of the piezoelectric layer.

13. The multi-layer transducer device, as claimed in claim 1, wherein:

said resistive layer is constructed such that the signal pathway resistance therethrough is tailored as a function of position across the element to provide directivity control;

the resistivity of the resistive layer is uniform across the element, and the resistance of the signal pathway to the connection point is adapted to provide position-dependence.

14. The multi-layer transducer device, as claimed in claim 1, wherein:

the resistive layer is constructed such that the signal pathway resistance therethrough is tailored as a function of position across the element, and the effective resistivity of the resistive layer is varied across the element to provide position-dependence.

15. The multi-layer transducer device, as claimed in claim 14, wherein variation in effective resistivity of the resistive layer is achieved either by altering the chemical/molecular composition of the material thereof, or by altering the thickness or physical disposition of the material thereof.

16. The multi-layer transducer device, as claimed claim 1, wherein:

either the chemical/molecular composition of the material the capacitive layer is varied to adjust the dielectric property of the layer, or the thickness or physical disposition of the material the capacitive layer is varied to adjust the dielectric property of the layer, such that the capacitance of the capacitive layer is tailored as a function of position across the element to provide position-dependence and adapt said capacitive layer to achieve directivity control.

17. The multi-layer transducer device, as claimed in claim 1, wherein the electrically-conductive layer is a layer having high electrical conductivity.

18. The multi-layer transducer device, as claimed in claim 1, comprising an active transducing element comprising:

at least one layer of inactive capacitive material with a first face having adjacent thereto a layer of an electrically-resistive material, and a second face having adjacent thereto a layer of piezoelectric material.

19. The multi-layer transducer device, as claimed in claim 1, wherein the or each capacitive layer is inactive, and for operation the element is placed in a magnetic field that interacts with signal-derived currents generated within the element.

20. The multi-layer transducer device, as claimed in claim 1, wherein the element is comprised, either actually or in effect, of an area-extensive array of smaller elements arranged side by side, and each of such smaller element has an electric signal and an electrical extraction connection.

21. An acoustic transducer utilizing a multi-layer transducer device, as claimed in claim 1.

* * * * *